US005725114A

United States Patent [19]

Pickman

[11] Patent Number: 5,725,114

[45] Date of Patent: Mar. 10, 1998

[54] CHILD RESISTANT CAP AND CONTAINER INCORPORATING SAME

[76] Inventor: E. Steven Pickman, 209 Montowese St., Branford, Conn. 06405

[21] Appl. No.: 714,199

[22] Filed: Sep. 16, 1996

[51] Int. Cl.[6] ..... A61J 1/00

[52] U.S. Cl. ..... 215/204; 215/206; 215/295; 220/255; 220/256

[58] Field of Search ..... 215/202, 204, 215/205, 206, 208, 214, 215, 217, 218, 219, 220, 221, 295, 301, 303; 220/255, 256

[56] References Cited

U.S. PATENT DOCUMENTS

| | | | |
|---|---|---|---|
| 2,487,728 | 11/1949 | Quiring | 215/221 X |
| 3,426,930 | 2/1969 | Hirchler | 215/221 |
| 3,601,274 | 8/1971 | Johnson | 215/208 X |
| 3,841,513 | 10/1974 | O'Connor et al. | 215/204 X |
| 3,923,185 | 12/1975 | Choksi et al. | 215/253 |
| 5,176,269 | 1/1993 | Herman | 215/228 |
| 5,255,813 | 10/1993 | Berggren et al. | 220/278 |
| 5,316,399 | 5/1994 | Joulia | 215/303 X |

*Primary Examiner*—Stephen Cronin
*Attorney, Agent, or Firm*—Bachman & LaPointe, PC

[57] ABSTRACT

A child resistant container apparatus includes a container for containing a substance and having an opening; a first inner cap member for removably covering the opening; first threads for rotationally engaging the first cap with the opening in a first direction of rotation; a second outer cap member for removably covering the first cap; and second threads for rotationally engaging the second cap with the first cap in a second direction of rotation, wherein the first direction of rotation is opposite to the second direction of rotation. The first and second direction are selected to provide opening of the container through rotation in an unexpected direction.

15 Claims, 1 Drawing Sheet

CHILD RESISTANT CAP AND CONTAINER INCORPORATING SAME

CROSS REFERENCE TO DISCLOSURE DOCUMENT

This application is related to U.S. Disclosure Document No. 371,950 filed Mar. 6, 1995 with the U.S. Patent and Trademark Office.

BACKGROUND OF THE INVENTION

The invention relates to a closure device and, more specifically, to a child resistant cap and container incorporating same.

Numerous proposals and disclosures have been made regarding "child proof" or child resistant caps or containers for containing various articles such as medication and the like which are intended to prevent unauthorized or unsupervised access of children to potentially hazardous materials while allowing adults or intended users to easily access them.

Existing devices typically include complicated structures requiring complicated operations to open, and can lead to extreme frustration even with adult users. Further, the complicated structures of such devices add to the cost of the container and, therefore, to the overall cost of the product contained therein.

It is clear that the need remains for a simple and effective child resistant cap and container incorporating same which is effective in resisting child access, yet easily operable by adults and other intended users.

It is therefore the primary object of the present invention to provide a child resistant cap and container incorporating same which is both child resistant and user friendly.

It is a further object of the present invention to provide a child resistant cap and container incorporating same which is simple and inexpensive to manufacture.

It is still another object of the present invention to provide a child resistant cap and container incorporating same which is readily adaptable to a wide variety of different packages or containers.

Other objects and advantages of the present invention will appear hereinbelow.

SUMMARY OF THE INVENTION

In accordance with the invention, the foregoing objects and advantages have been readily attained.

According to the invention, a child resistant container apparatus is disclosed which comprises container means for containing a substance and having an opening; a first inner cap member for removably covering the opening; first means for rotationally engaging the first cap with the opening in a first direction of rotation; a second outer cap member for removably covering the first cap; and second means for rotationally engaging the second cap with the first cap in a second direction of rotation, wherein the first direction of rotation is opposite to the second direction of rotation.

According to a preferred embodiment of the invention, the container and the first or inner cap are the same color and/or made of the same material. In accordance with each of the foregoing preferred embodiments, the inner cap is made to appear as though it is a portion of the container, thereby disguising or camouflaging the actual nature thereof.

In accordance with a still further embodiment of the present invention, the second cap is a different color and/or material than the first cap so as to further enhance the intended image that the first cap is a portion of the container.

In accordance with a still further preferred embodiment of the invention, the first direction of rotation for engaging the first cap with the container is counter clockwise, while the second direction of rotation for engaging the second cap with the first cap is clockwise. This structural combination serve to provide removal of the second cap only when the second cap is turned in the expected counter clockwise direction for opening, thereby leaving the inner cap in place blocking access to the container as desired.

BRIEF DESCRIPTION OF THE DRAWINGS

A detailed description of preferred embodiments of the invention follows, with reference to the attached drawings wherein.

DETAILED DESCRIPTION

Figure 1:
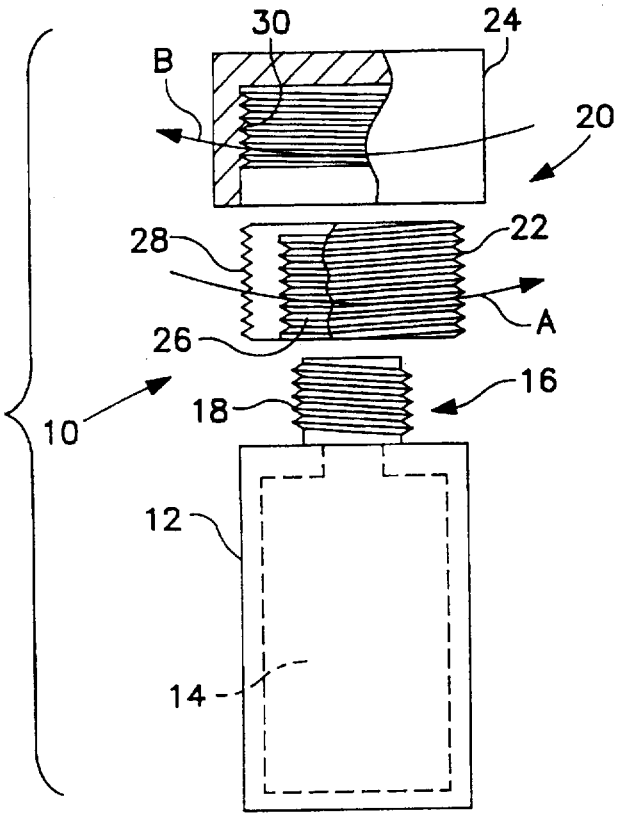
FIG. 1 is a side view of a container and cap assembly in accordance with the invention.

The invention relates to a child resistant cap and a container incorporating same. In accordance with the invention, a cap is provided which, when attempted to be opened in a conventional way, results in removal of an outer cap portion leaving an inner cap portion in place on the container blocking access thereto. In accordance with the invention, the inner cap portion is preferably designed to have the appearance of an integral portion of the container as will be discussed below so as to discourage further attempts to open the container.

Referring to the drawings, a container assembly incorporating a child proof cap assembly in accordance with the present invention is referred to generally by reference numeral 10. As shown in the drawing, container assembly 10 preferably includes a container portion 12 defining an interior space 14 for holding a material such as medication and the like or any other substance or article to which restricted access is desirable. Container portion 12 has an opening 16 typically having an outwardly threaded portion 18 for receiving a cap.

In FIG. 1, the child resistant cap assembly of the present invention is referred to generally by reference numeral 20. Cap assembly 20 includes an inner cap member 22 and an outer cap member 24. According to the invention, inner cap 22 preferably has inner threads 26 and outer threads 28, and outer cap 24 preferably has inner threads 30, the function of which will be discussed below.

In accordance with the invention, threaded portion 18 of opening 16 of container 12 and inner threads 26 of inner cap 22 are designed to rotationally engage one another in a first direction of rotation. Further, outer threads 28 of inner cap 22 and inner threads 30 of outer cap 24 are preferably adapted to rotationally engage one another in a second direction of rotation. In accordance with the invention, and advantageously, the direction of rotation for engagement of inner cap 22 with container 12 is opposite to the direction of rotation for engagement of outer cap 24 with inner cap 22. According to the invention container assembly 10 is adapted as will be discussed below so as to encourage an unintended user to rotate outer cap 24 out of engagement with inner cap 22, thereby removing outer cap 24 and leaving inner cap 22 in place blocking unintended access to objects within container 12.

As shown in FIG. 1, the first direction of rotation for engagement of inner cap 22 with container 12 is preferably rotation in a counter-clockwise direction as indicated by arrow A. The second direction of rotation for engagement of outer cap 24 with inner cap 22 is preferably a clockwise direction as indicated by arrow B. In this manner, advantageously, rotation of outer cap 24 in the expected counter clockwise direction, relatively standard for removal of a cap, serves to remove only outer cap 24, leaving inner cap 22 in place on container 12 and blocking access to interior space 14 as desired in accordance with the present invention.

Figure 2:
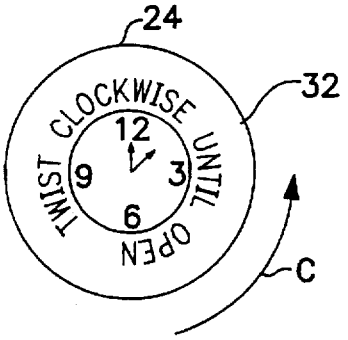
FIG. 2 is a top view of the container with both caps in position.

FIG. 2 shows a top view of outer cap 24 which, in accordance with a preferred embodiment of the invention, is preferably provided with indicia 32, preferably textual indicia, for indicating to an adult or intended user how to properly open container assembly 10 by indicating the proper direction of rotation for removal of both caps 22, 24. Customarily, threaded caps are removed through counter clockwise rotation as indicated by arrow C in FIG. 2. In accordance with the present invention, rotation of outer cap 24 in a counter clockwise direction results in removal only of outer cap 24 as described above leaving inner cap 22 in place. However, rotation of outer cap 24 in accordance with the instructions of indicia 32 results in complete engagement of outer cap 24 with inner cap 22 and subsequent disengaging rotation of inner cap 22 relative to container 12 so as to remove both inner cap 22 and outer cap 24 from opening 16 as desired in accordance with the present invention.

Figure 3:
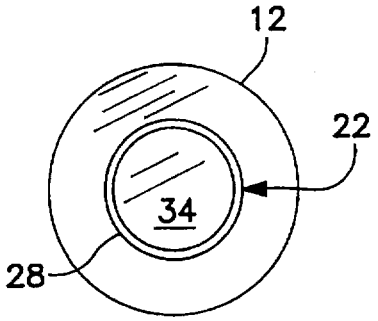
FIG. 3 is a top view of a container according to the invention with the outer cap removed.

FIG. 3 shows a top view of container assembly 10 with outer cap member 24 removed and inner cap 22 still in place. As shown, inner cap 22 has a flat closed top surface 34 which serves to cover opening 16 of container 12 and prohibit access to a user who fails to follow the instructions given by indicia 32.

Figure 4:
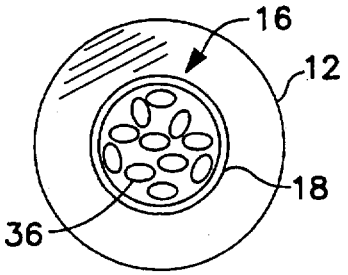
FIG. 4 is a top view of a container according to the invention with both caps removed.

FIG. 4 shows a top view of container 12 with both outer cap 24 and inner cap 22 removed so as to show opening 16 and allow access to articles 36 within interior space 14 of container 12.

Figure 5:
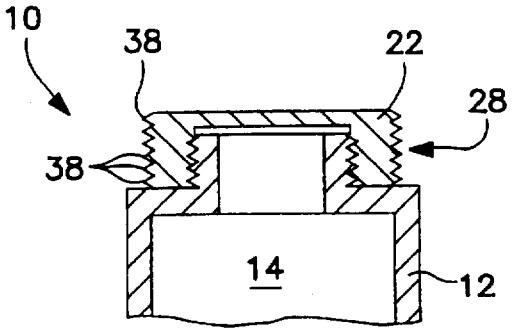
FIG. 5 is a side sectional view of a container according to the invention with the inner cap in position.

Referring to FIG. 5, a cross-sectional view is provided showing container 12 with inner cap 22 in position covering opening 16. In accordance with a preferred embodiment of the invention, outer threads 28 of inner cap 22 are preferably provided having sharp ridges or points 38 which serve in accordance with the invention to deter the manual grasping of inner cap 22 with outer cap 24 removed. Advantageously, in accordance with the invention, sharp ridges 38 serve to discourage persons such as children attempting to access container 12 from attempting to grasp and remove inner cap 22 after outer cap 24 has been removed. As shown in the drawings, the sharp radially extending structure is easily incorporated into threads 28. However, any sharpened radially extending structure for deterring the grasping of inner cap 22 is suitable in accordance with the present invention.

In accordance with another preferred embodiment of the invention, inner cap 22 is preferably adapted to have the appearance of an integral part or portion of container 12. In accordance with this embodiment, inner cap 22 and container 12 are preferably made of the same material, and further are preferably the same color, so that upon removal of outer cap 24 leaving inner cap 22 in place, inner cap 22 has the appearance of being an integral portion of container 12, thereby discouraging further attempts to open the container. Further, to highlight the above "camouflage" of inner cap 22, outer cap 24 may preferably be provided of a different material having a different color from inner cap 22 and container 12.

As set forth above, threads 18 and 26 serve to provide for rotational engagement of inner cap 22 with opening 16, and outer threads 28 and inner threads 30 serve to provide for rotational engagement of outer cap 24 with inner cap 22. It is desirable according to the invention to provide threads 18, 26, 28 and 30 having a desired pitch or rate of advance, and made from materials having desired relative frictional engagement, so as to allow relative rotation of threads 28, 30 with a smaller force than is required for relative rotation of threads 18, 26. In this way, a user not knowing that outer cap 24 must be rotated in a certain direction such as indicated by arrow A in FIG. 1 or indicia 32 would be encouraged to rotate outer cap 24 in the direction of arrow C (FIG. 2) resulting in removal of outer cap 24 only.

According to the invention, container assembly 10 is used by an authorized user as follows. Rotation of outer cap 24 in a clockwise direction as indicated by indicia 32 results in outer cap 24 engaging inner cap 22 and, when rotation of outer cap 24 relative to inner cap 22 is no longer possible, caps 22, 24 turn together, still in the clockwise direction, until both caps 22, 24 of cap assembly 20 are removed and access to container 12 is provided as desired. It is noted that this configuration of the preferred embodiment allows opening of container 12 only by rotating outer cap 24 in the non-standard direction for opening a container.

When container 12 is to be closed, cap assembly 20 is threaded back on to container 12 until inner cap 22 is fully engaged with opening 16, and outer cap 24 begins to rotate relative to inner cap 22.

Figure 6:
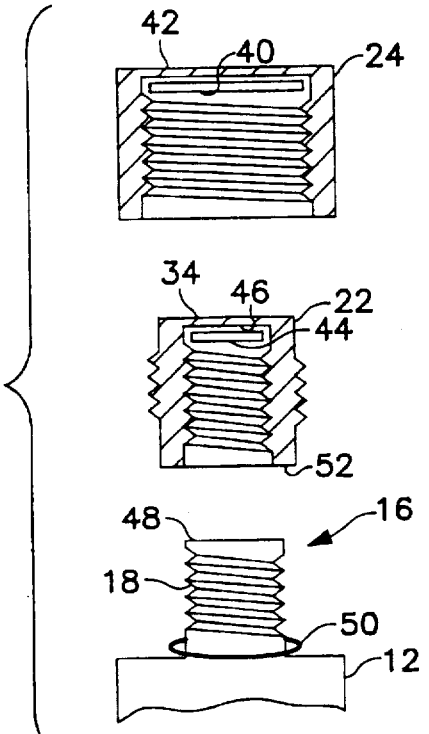
FIG. 6 is a side partially sectional view illustrating several preferred embodiments of the present invention.

It is desirable to ensure that caps 22, 24 do not become over tightened which can lead these elements to seize against one another and thereby interfere with proper operation. Referring to FIG. 6, an exploded view of a container 12 and cap assembly 20 is provided illustrating several embodiments which provide enhanced operation and help to prevent over tightening and/or seizing. As shown, outer cap 24 may include a shim or gasket 40 for example positioned on an inside top surface 42 of outer cap 24. Gasket 40 serves to contact top or upper surface 34 of inner cap 22 when outer cap 24 is completely engaged with inner cap 22 so as to prevent seizing between these parts. Gasket 40 may suitably be a flexible member to prevent seizing, or may be an enhanced slip member made of a friction reducing material such as teflon for facilitating rotation of outer cap 24 out of complete engagement with inner cap 22.

Still referring to FIG. 6, inner cap 22 may also be provided with a gasket 44 positioned on inside top surface 46 so as to contact upper edge 48 of opening 16 of container 12 and thereby prevent seizing similarly to gasket 40.

Container 12 may also be provided with a gasket, preferably a ring member 50 positioned around opening 16 to contact a lower edge 52 of inner cap 22 and prevent seizing in a similar manner to gaskets 40, 44. It is noted that any one or more of gaskets 40, 44 and ring 50 may be provided so as to enhance the proper opening and closing operations of cap assembly 20 according to the invention.

It is also noted that one or more gaskets 40, 44 and ring 50 may be provided so as to enhance the seal between cap assembly 20 and opening 16 of container 12, especially for applications wherein a liquid or fluid is to be stored within container 12. In this embodiment, gaskets 40, 44 and/or ring 50 are preferably provided from a sealing material so as to provide a good seal between caps 22, 24 and opening 16 without excessive tightening while preventing leakage of the fluid from container 12 as desired.

It should be noted that cap assembly 20 in accordance with the present invention is suitable for use with a wide variety of containers, bottles and the like, so long as the container is adapted for threaded engagement of a cap. Further, outer cap 24 may be provided of various size and shape so as to enhance the user friendly nature of cap assembly 20. For example, outer cap 24 may be provided with wings, grooves, flanges and the like to assist in proper opening and closing of container assembly 10 in accordance with the invention.

It should also be noted that the above disclosure and drawings show threads 18, 26, 28 and 30 all as continuous thread members. It should be noted that at least some of these members could alternatively be provided as partial threads within the scope of the present invention, so long as caps 22, 24 engage one another and inner cap 22 engages opening 16 in a rotational manner. Also, threads 18, 26, 28 and 30 may be provided having any number of turns as appropriate for a particular application.

Thus provided is a child resistant cap or closure for a container, and a container incorporating such a cap or closure, which is simple in manufacture, user friendly for users understanding indicia 32, and resistant to child users unable to read indicia 32, all as desired in accordance with the present invention.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A child resistant container apparatus, comprising:

(a) container means for containing a substance and having an opening;

(b) a first inner cap member for removably covering the opening;

(c) first means for rotationally engaging the first cap with the opening in a first direction of rotation;

(d) a second outer cap member for removably covering the first cap; and (e) second means for rotationally engaging the second cap with the first cap in a second direction of rotation, wherein the first direction of rotation is opposite to the second direction of rotation, wherein the first inner cap and the second outer cap have a true opening position wherein the first inner cap and the second outer cap are engaged for rotation in the second direction, and wherein the integrity of the first inner cap is maintained regardless of rotation and position of the second outer cap.

2. An apparatus according to claim 1, wherein the first means comprises container outer threads on the opening and first cap inner threads on the first cap for engaging the container outer threads, and wherein the second means comprises first cap outer threads on the first cap and second cap inner threads on the second cap for engaging the first cap outer threads.

3. An apparatus according to claim 1, wherein the container and the first cap are made of the same material.

4. An apparatus according to claim 3, wherein the second cap is made of a different material from the first cap.

5. An apparatus according to claim 1, wherein the container and the first cap are the same color.

6. An apparatus according to claim 5, wherein the second cap is a different color than the first cap.

7. An apparatus according to claim 1, wherein the first direction of rotation is counter-clockwise and the second direction of rotation is clockwise.

8. An apparatus according to claim 1, wherein the first cap has an outer surface, and wherein at least a portion of the outer surface of the inner cap has a sharpened radially directed member whereby grasping of the outer surface of the first cap is discouraged.

9. An apparatus according to claim 8, wherein the sharpened radially directed member is defined on the second means.

10. An apparatus according to claim 1, wherein the first means requires a first force for rotation and the second means requires a second force for rotation, and wherein the second force is smaller than the first force.

11. An apparatus according to claim 1, further comprising textual indicia on the second cap for indicating a direction of rotation of the second cap for removing the first cap and the second cap from the container.

12. An apparatus according to claim 1, further comprising gasket means on at least one of the first cap, the second cap and the container for contacting at least one other of the first cap, the second cap and the container and for reducing friction therebetween.

13. An apparatus according to claim 12, wherein the gasket mean further comprises seal means for preventing leakage of fluid from the container.

14. An apparatus according to claim 1, further comprising seal means on at least one of the first cap, the second cap and the container for contacting at least one other of the first cap, the second cap and the container and for sealing therebetween to prevent leakage of fluid from the container.

15. A cap assembly for a container having an opening, comprising:

an inner cap member having means for rotationally engaging the opening of a container in a first direction of rotation;

an outer cap member; and means for rotationally engaging the outer cap member with the inner cap member in a second direction of rotation, wherein the first direction of rotation is opposite to the second direction of rotation, wherein the first inner cap and the second outer cap have a true opening position wherein the first inner cap and the second outer cap are engaged for rotation in the second direction, and wherein the integrity of the first inner cap is maintained regardless of rotation and position of the second outer cap.

* * * * *